United States Patent [19]

Dumont

[11] 4,341,389

[45] Jul. 27, 1982

[54] WORD FINDING AND GUESSING GAME

[76] Inventor: Bernard Dumont, 95 Bellevue, Apt. 306, Sherbrooke, Quebec, Canada, J1J 3Z2

[21] Appl. No.: 145,465

[22] Filed: May 1, 1980

[51] Int. Cl.[3] ..... A63F 3/00

[52] U.S. Cl. ..... 273/265; 273/239; 273/272; 273/285

[58] Field of Search ..... 273/239, 265, 272, 282, 273/287, 285

[56] References Cited

U.S. PATENT DOCUMENTS

| | | | |
|---|---|---|---|
| 2,585,463 | 2/1952 | Horine | 273/272 X |
| 3,524,648 | 8/1970 | Nilan | 273/239 |
| 3,891,218 | 6/1975 | Hilgartner et al. | 273/272 |
| 3,948,526 | 4/1976 | Lukacik | 273/265 |
| 4,012,044 | 3/1977 | Grossi | 273/265 X |
| 4,194,742 | 3/1980 | Adams | 273/265 |

*Primary Examiner*—Anton O. Oechsle

[57] ABSTRACT

The disclosure describes a game to be used by two players and which involves the guessing by one player of a word selected by the opposite player. Each player has at his disposal a plurality of each of the letters of the alphabet, and if desired, a plurality of question marks and also a plurality of blank marks. There are two columns of consecutively aligned numerals opposite which can be disposed letters forming a word. A set of one column and one channel to place the letters, is intended for the word selected by one player while another set will be used by the same player for the word which he is trying to guess. By questions and answers, the player will try to locate the position occupied by the word to be guessed, opposite a particular column, after which he will try to identify each letter of the word to be guessed. In his turn, the opposite player will also try to arrive at guessing the word selected by the first player. This game is an excellent tool to develop the vocabulary of a person.

1 Claim, 8 Drawing Figures

WORD FINDING AND GUESSING GAME

This invention relates to a game. More particularly, the invention relates to a game in which a player tries to guess a word selected by another player and vice versa.

There are thousand of games available. Some of them are of the so-called educational kind in the sense that while constituting a hobby or the players involved, they may also, indirectly, contribute to teach something to the players. There are all sorts of games involving the guessing of a word, which all have their particular characteristics.

In my own game, whereby a player tries to guess a word selected by another player, there are a plurality of each of the letters of the alphabet, at least two columns of consecutively aligned numerals, first means to fixedly dispose a first plurality of letters in an order forming a word selected by said one player along a first row adjacent to one of said at least two columns of numerals so that each letter of said selected word is placed opposite a selected numeral from said one column, the consecutive letters of said selected word corresponding to a first set of consecutive numerals, the first selected numerals from said first set corresponding to the first letter of the selected word, and being chosen at random by said one player, and second means to fixedly dispose a second plurality of letters in an order forming a guessed word along a second row of letters adjacent another of said at least two columns of numerals so that each letter of said guessed word is placed opposite a selected numeral from said another column, the consecutive letters of said guessed word corresponding to a second set of consecutive numerals, the first selected numeral from said second set corresponding to the first letter of the guessed word, and being chosen at random by said another player, so constructed and arranged that by questions and answers, said one player tries to locate the position occupied by the word to be guessed opposite said another column, after which said one player tries to identify each letter of said word to be guessed and then places the same in an appropriate location in said second row opposite a corresponding numeral of said second column, and vice versa with respect to said another player.

The invention will now be illustrated by means of the annexed drawings which are only given for the purpose of illustration and are not in any way intended to limit the scope of the appended claims, and in which FIG. 1 is a perspective view of an embodiment of a game according to the invention;

Figure 1:
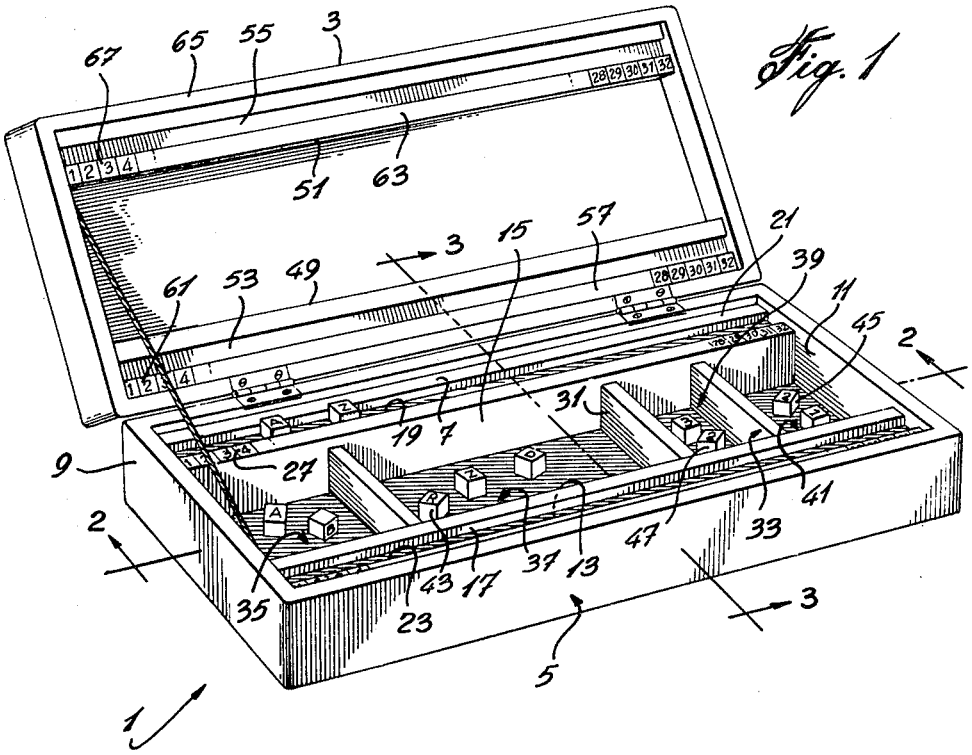
Figure 2:
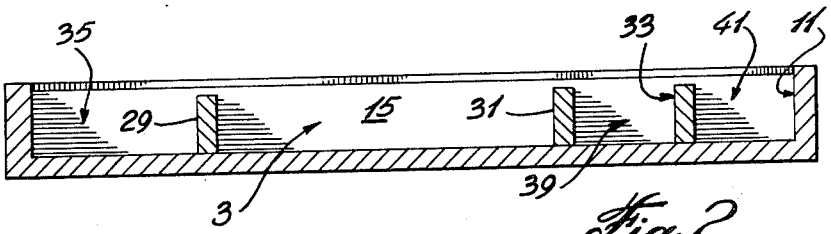
FIG. 2 is a cross-section view taken along line 2—2 of FIG. 1.
Figure 3:
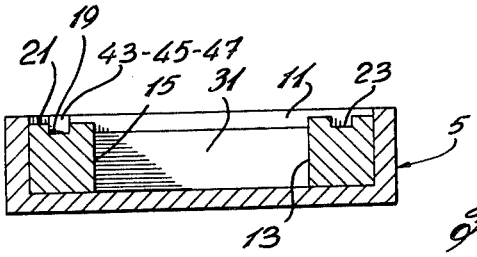
FIG. 3 is a view taken along line 3—3 of FIG. 1.
Figure 4:
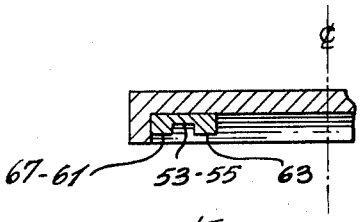
FIG. 4 is a partial cross-section view through the lid.
Figure 5:
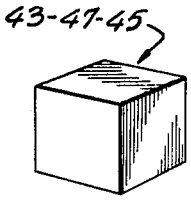
FIG. 5 is a view of a cube carrying a letter, a question mark or a blank mark.

Referring to the embodiments illustrated by FIGS. 1 to 5, it will be seen that the game consists of a chest 1 having a lid 3. The chest 1 contains as usual a front side 5, a rear side 7, and a lateral side 9 and 11. Inside the chest 1, there are two U-shaped members 13 and 15. Each defining a respective channel 17,19. It will be noted that both U-shaped members 13,15 are disposed longitudinally in the chest 1 in a vertical position respectively against front side 5 and rear side 7 all in the manner as shown in FIGS. 1 and 3 of the drawings.

Turning to U-shaped member 13, which is mounted opposite the front side 5, the uper edge 21 thereof which is adjacent to the front side 9 carries a column of consecutively aligned numerals numbered 1 to 32. This column will be referred to by reference numeral 23.

With respect to the U-shaped member 15, in that particular case, the edge 25 which is spaced from the rear side 7 carries an identical column of consecutively aligned numerals from 1 to 32 which will be referred by reference numeral 27.

As shown, the chest 1 contains tranverse partitions 29,31 and 33 to define compartments 35,37,39,41. These compartments will be used to store the various marks such as letters 43, question marks 45 and blank marks 47.

The marks 43,45 and 47 are in the form of cubes which are of prismatic configuration and which are shaped to be enable to slide within the channels 17,19.

Turning now to the lid, there are shown two inverted U-shaped members 49,51 defining respectively channels 53,55.

The lower edge 57 of inverted U-shaped member 53 adjacent the rear side 59 carries a column 61 of consecutively aligned numerals 1 to 32. Similarly, the lower edge of inverted U-shaped member 51 spaced from the front side 65 of the lid 3 carries a column 67 consecutively aligned reference numerals 1 to 32. The channels 53,55 are adapted to enable a mark such as blank mark 47 to slide therein opposite a selected reference numeral.

Figure 6:
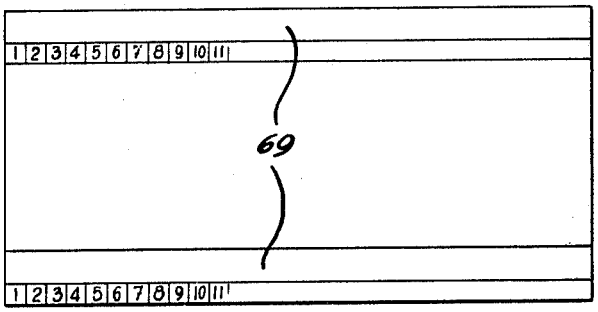
FIG. 6 is a view of the same game using magnetic bands to place the letters, question marks or blank marks.
Figure 7:
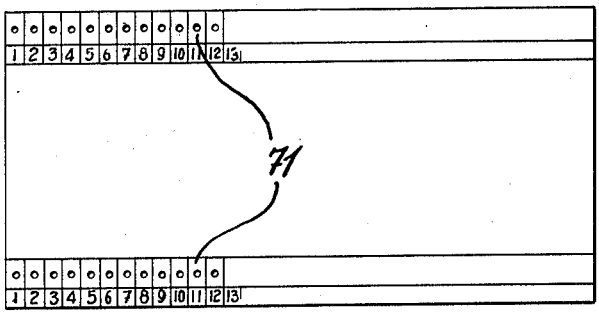
FIG. 7 is a view showing the use of bases containing holes to receive letters, question marks or blank marks provided with pins.
Figure 8:
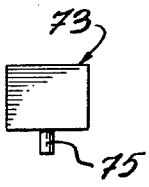
FIG. 8 is a view of a mark carrying a pin.

Instead of relying on U-shaped members and inverted U-shaped members as described above for the marks to be placed opposite a reference numeral one may rely on a magnetic band 69 as shown in FIG. 6. This magnetic band can be used to replace all channels 17,19,53,55. Of course, in such a case, the marks will have to be constructed in known manner and not necessarily in the form of cubes.

Another alternative form would be to design bases provided with holes 71 and to manufacture the marks as a prism 73 with a small pin 75 underneath, the pin 75 capable of being received in the holes of bands 71.

The rules of the game are as follows.

Two chests or boxes are provided and in each one of them, there are two tables of figures numbered from 1 to 32 such as shown at 23 and 27 in FIG. 1 of the drawings. Blank cubes, question mark cubes and cubes carrying the letters of the alphabet are provided and are contained in the compartments 35,37,39 and 41.

The game requires two players. Each player selects a word which he places at the location of his choice between the reference numerals 1 to 32 in channel 17 opposite column 23. This word should be in the dictionary, and unless the players have decided otherwise, excluded are geographical names, surnames, foreign names, unless the players have decided to play in another language.

A coin is flipped to decide which of the players will play the first and then the game starts.

The first player gives a reference numerai from table 23 (i.e. from 1 to 32). If this number is opposite a letter, which the other player indicates, the player then places a question mark 45 in his own channel 19 at the apropriate location opposite the number which has been named. The player then continues to give other reference numerals until he misses. He then places a blank mark at the location which he has just named in table 19 opposite column 27 and then it is now the turn of the other player.

When a player has finally localised the word of the other player, he gives a letter of the alphabet and if this letter is comprised within the word, the other player indicates the location by giving the reference numeral and the player then places the letter at the proper location in his own channel 19 opposite the indicated reference numeral of column 27. He then gives another letter until he misses or until he finds the entire word.

Whenever a player misses by giving the wrong reference numeral or the wrong letter, it is automatically the turn of the other player to play.

When a letter is given and it does not form part of the word of the other player, this letter should be set aside such as in compartment 35 in order not to name it a second time.

The game ends when a player has found the word selected by the other player.

The manner of computing points is left to the imagination of the players. However, the easiest way is to mark them along the two columns 61 and 67 which are provided in the lid 3 using blank marks 47.

I claim:

1. A game whereby one player tries to guess a word selected by another player, which comprises a chest including a lid, said chest having a front side and a rear side, a first U-shaped member defining a first channel disposed longitudinally in said chest along said front side and a second U-shaped member defining a second channel disposed longitudinally in said chest along said rear side, a first column of consecutively aligned numerals on an upper edge of said first U-shaped member adjacent said front side, a first plurality of cubes carrying letters of the alphabet adapted to be disposed within said first channel so that a letter of said first plurality of cubes carrying letters can be placed opposite a numeral of said first column thereby enabling a first word selected by said one player and formed of a plurality of letters taken from said first plurality of cubes carrying letters, to be placed by said one player opposite consecutive numerals of said first column, the first one of said consecutive numerals of said first column being selected at random by said one player in said first column of consecutively aligned numerals, a second column of consecutively aligned numerals on an upper edge of said second U-shaped member spaced from from said rear side, a second plurality of cubes carrying letters of the alphabet adapted to be disposed within said second channel so that a letter of said second plurality of letters can be placed opposite a numeral of said second column, thereby enabling a word selected by said another player and formed of a plurality of letters taken from said second plurality of cubes carrying letters to be placed by said one player opposite consecutive numerals of said second column, the first one of said consecutive numerals of said second column being selected at random by said another player, said game also comprising blank cubes to indicate a wrong guess and cubes carrying question marks to indicate position of a letter opposite a specific numeral, transverse partitions between said first and second U-shaped members to define four containers, one said container being provided for said first and second plurality of cubes carrying letters of the alphabet, a second container to contain letters rejected by said one player as not forming part of the word selected by said another player and to be guessed by said one player, a third container to contain said blank cubes, and a fourth container to contain said question marks, said lid having a front side and a rear side, a first inverted U-shaped member defining a third channel disposed longitudinally in said lid along said rear side of said lid, a first additional column of numerals on a lower edge of said first inverted U-shaped member adjacent said rear side of said lid, said blank cubes being adapted to slide within said third channel, and indicate score of said one player, a second inverted U-shaped member defining a fourth channel disposed longitudinally in said lid along said front side of said lid, a second additional column of numerals on a lower edge of said second inverted U-shaped member spaced from said front side of said lid, said blank cubes being adapted to slide within said fourth channel and indicate score of said another player.

* * * * *